United States Patent [19]

Shennan

[11] 4,137,684

[45] Feb. 6, 1979

[54] BUILDING PANEL

[75] Inventor: John H. Shennan, St. Austell, England

[73] Assignee: Selleck Nicholls Williams (E.C.C.) Limited, Cornwall, England

[21] Appl. No.: 765,692

[22] Filed: Feb. 4, 1977

[51] Int. Cl.[2] ..... E04C 2/04

[52] U.S. Cl. ..... 52/602; 52/97; 52/236.3

[58] Field of Search ..... 52/97, 596–607, 52/236.3; 49/504, DIG. 1

[56] References Cited

U.S. PATENT DOCUMENTS

| | | | |
|---|---|---|---|
| 945,439 | 1/1910 | Beidler | 52/97 X |
| 1,493,991 | 5/1924 | Knight | 52/602 |
| 1,981,327 | 11/1934 | Rimmer | 52/97 |
| 2,249,125 | 7/1941 | Gabriel | 52/97 |
| 2,270,846 | 1/1942 | Hines | 52/602 |
| 2,320,480 | 6/1943 | Stagg | 52/597 X |
| 2,335,433 | 11/1943 | Minck | 52/602 |
| 3,139,048 | 6/1964 | Hall | 52/596 |
| 3,313,069 | 4/1967 | Jackson | 52/97 X |
| 3,478,482 | 11/1969 | Weir | 52/97 |
| 3,567,816 | 3/1971 | Embree | 52/602 X |
| 3,736,709 | 6/1973 | Koch et al. | 52/97 |

FOREIGN PATENT DOCUMENTS

| | | | |
|---|---|---|---|
| 155058 | 2/1954 | Australia | 52/602 |
| 2500437 | 7/1976 | Fed. Rep. of Germany | 52/97 |
| 1082089 | 6/1954 | France | 52/602 |
| 537187 | 6/1941 | United Kingdom | 52/602 |

*Primary Examiner*—J. Karl Bell

*Attorney, Agent, or Firm*—Larson, Taylor and Hinds

[57] ABSTRACT

A building element comprises a rectangular panel having four flanges projecting from one face thereof adjacent to the edges of the panel, wherein the bottom and side edges of the panel each have at least one groove running the length thereof and wherein the flanges are provided with means suitable for, or suitable for use in, the fixing of the building element to another similar or different building element. There is also disclosed a method of building a dwelling which includes forming a storey of said dwelling by erecting four walls from building elements, wherein the erection of the walls is started at one corner of the dwelling and proceeds laterally therefrom wherein lengths of wall longer than about 2 meters are supported by temporary brackets, wherein at least three of the four corners of the dwelling are braced during the erection thereof by securing struts to the tops of the walls defining each corner diagonally across the corner, and wherein a structural partition is secured to the floor of said storey and to one wall of the storey near the midpoint of that wall and is braced to the opposite wall by a temporary bracing strut.

4 Claims, 10 Drawing Figures

BUILDING PANEL

BACKGROUND OF THE INVENTION

This invention relates to buildings and, more particularly but not exclusively, is concerned with the construction of dwellings, for example bungalows, from prefabricated building elements, and with prefabricated building elements suitable for use in the construction of such dwellings.

Often there is no shortage of unskilled labour, but is is more difficult to recruit skilled tradesman who are capable of performing some of the operations which, in more highly developed countries, are common in conventional methods of construction. In addition, in some areas there is a serious risk that during construction there may occur high winds of up to hurricane force which can cause considerable damage to buildings, especially when they are in a partially constructed state.

It is an object of the present invention to provide a method of building a dwelling which can be employed by unskilled labour and yet is suitable for use in areas where inclement weather, and especially high winds, occur. It is a further object of the present invention to provide a building element suitable for use in the method of building a dwelling according to the present invention.

SUMMARY OF THE INVENTION

Accordingly, in one aspect the present invention provides a building element which comprises a rectangular panel having an inner face, an outer face, a top edge, a bottom edge and two side edges, wherein the inner face has four flanges each of which projects from said inner face adjacent to a respective one of said top, bottom and two side edges, each of said flanges extending the whole or substantially the whole length of the edge to which it is adjacent, wherein the bottom edge and the two side edges each have at least one groove running the length thereof, and wherein the flanges adjacent said top, bottom and two side edges are provided with means suitable for, or suitable for use in, the fixing of the building element to another similar or different building element.

The building elements of the invention are conveniently prepared from cementitious compositions such as concrete, with reinforcing steelwork or the like being advantageously embedded in the cementitious composition to increase the strength thereof.

In one embodiment of this first aspect of the invention the outer face of the rectangular panel has an outwardly flared portion adjacent the bottom edge, and with this embodiment the grooves in the side edges diverge outwardly at the bottom the side edges so as to run parallel to, or substantially parallel to, the outer face of the building element. The outwardly flared portion at the bottom of the outer face carries any rainwater impinging on the outer face of the building element clear of whatever the building element is secured to at its bottom edge, for example a concrete plinth forming the floor of a dwelling.

The groove or grooves provided in the bottom and side edges, and especially in the bottom edge, of the rectangular panel, impede(s) the progress of water from the outer face to the inner face of the panel. When the rectangular panel has a flared portion adjacent the bottom thereof, the grooves in the side edges diverge outwardly at the bottom of the side edges and the panel can be erected so that the grooves carry rainwater clear of, for example, a concrete plinth on which the building element is mounted. The grooves preferably have a polygonal cross-section, as it has been found that a groove of this shape is most effective in causing water to flow along the groove rather than penetrating past the groove.

The flanges adjacent said bottom and top edges of the rectangular panel are conveniently provided with one and two bolt-holes, respectively, whereby the building element can be fixed, respectively, to the floor (or to the foundation of the building) and to a ring beam which in turn can be fixed to an upper floor or to the roof of the building.

The flanges adjacent said side edges of the rectangular panel are conveniently provided with bolt-holes through which two adjacent building elements may be secured, i.e. bolted, together. Alternatively they can be provided with inserts, advantageously made of a plastics material and preferably of frusto-conical shape so that they are not easily pulled out of the concrete, so that adjacent building elements can be secured together by screws. The side flanges are preferably each provided with two or more inserts to enable a timber batten to be secured to the side flanges of two adjacent building elements on the inner face of the building element to mask the join between the elements and to facilitate the fixing to the building element of an inner skin of sheet material.

According to a second aspect of the invention there is provided a method of building a dwelling which method includes forming a storey of said dwelling by erecting four walls to define a rectangular area, each of said four walls being formed from building elements including a plurality of prefabricated wall panels, wherein the erection of said four walls is started at one corner of the rectangular area and proceeds laterally therefrom, wherein lengths of wall longer than about 2 meters are supported by temporary brackets, wherein at least three of the four corners of the rectangular area are braced by securing struts temporarily to the tops of the two walls defining each corner diagonally across the corner, and wherein a structural partition is secured to the floor of said storey and to one wall of the storey near the midpoint of the wall and is braced to the opposite wall by a temporary bracing strut, the structural partition extending at least one third of the distance to the wall opposite to that to which it is secured.

Advantageously, the or a substantial proportion of the wall panels used in the method of the invention are prefabricated building elements constructed so as to be in accordance with the first aspect of the invention.

The corners of the storey can be formed either from (a) corner pillars which conveniently each have a square cross-section (for example, 4 inches × 4 inches or 10 cm × 10 cm) and which are preferably constructed so that the two faces which, when the pillar is erected, will be facing outwards are outwardly flared at the bottom in a similar manner to the preferred embodiments of the prefabricated building elements according to the first aspect of the invention, or from (b) corner wall panels which are cast so as to have a corner pillar integral with the wall panel, the panel therefore being longer than a simple wall panel by an amount equal to the size of the faces of a square cross-section corner pillar. If a corner pillar is constructed separately from a wall panel it will generally be secured to a wall panel, to form a corner wall panel, before it is erected.

In addition to the wall panels, one or more of the walls will include joinery units each of which may each comprise a rectangular timber frame inside which are fitted different arrangements of uprights and transoms which define door and/or window frames. When the joinery unit accommodates a window which occupies only the upper part of the unit, the lower part of the unit is covered on the outside with a suitable sheet material, for example plywood of half inch thickness which is painted for decorative and protective purposes.

In one embodiment of the method of the invention a dwelling in the form of a bungalow of generally rectangular plan is built by the steps of:

A constructing the foundation for the dwelling and forming thereon a concrete plinth, the concrete plinth being provided around the periphery thereof with means for use in anchoring wall panels thereto;

B erecting the walls of the dwelling by (a) securing a concrete corner wall panel to appropriate anchoring means in the concrete plinth to form part of a first wall of the dwelling;

(b) securing a concrete wall panel to the corner pillar of the concrete corner wall panel and to appropriate anchoring means in the concrete plinth so as to form a right angle corner with said concrete corner wall panel and form part of a second wall of the dwelling;

(c) extending one of said first and second part walls laterally by adding further concrete wall panels and/or timber-framed joinery units until the length of the wall is at least about 2 meters but not more than about 6 meters;

(d) placing against the inner face of an erected wall panel a temporary bracket which has the shape of a right-angled triangle and attaching said temporary bracket to said wall panel in order to prevent movement of the wall containing said erected wall panel in a direction perpendicular to the plane of the wall;

(e) applying means to said temporary bracket to prevent lateral movement thereof;

(f) placing a first ring beam along the top of the wall panels comprising one of said first and second part walls and securing it to the top of the part wall, the length of the ring beam being such as to extend from the corner pillar to a point just short of the temporary bracket;

(g) extending the other of said first and second part walls laterally by adding thereto concrete wall panels and/or joinery units until its length is at leat about 2 meters but not more than about 4 meters;

(h) placing a second ring beam along the top of the wall panels comprising said other part wall and securing it to said other part wall, the length of said second ring beam being a little less than the total length of said other part wall;

(i) placing a bracing strut diagonally across the right-angle corner and securing it temporarily to the two ring beams, the length of the strut being in the range of from 3 meters to 5 meters;

(j) removing the temporary bracket;

(k) completing the first and second part walls and forming the other walls and corners by adding wall panels, including corner pillars where appropriate, and/or joinery units using a temporary bracket to restrain movement of a part wall when the length of unsupported wall extending from a corner or from one end of a bracing strut reaches from 2 to 6 meters, ring beams being secured to the top of the wall panels and corners being braced temporarily with struts;

(l) during the construction of the walls, securing a structural partition to one of the two longer walls of the rectangular dwelling at or near the mid-point of the wall, said structural partition having a length which is at least one third of the length of the shorter walls of the rectangular dwelling, and (m) securing the upper corner of the end of the structural partition remote from said one longer wall of the dwelling to the ring beam on the other longer wall by a bracing strut making a small angle with the plane of the structural partition; and C when the walls have been erected with all the ring beams secured in place, constructing the roof, during the course of which the bracing struts are removed and additional stiffneess is conferred to roof trusses by means of panels of substantially rigid sheet material which are laid across the corresponding inclined members of two or more adjacent roof trusses and secured thereto.

In step A the anchoring means for the wall panels are preferably bolts, for example, ragbolts set into the concrete plinth. These may be located accurately by means of a timber batten provided with holes at the correct centres in which the bolts are suspended, the batten being laid horizontally along the top edge of the vertical shuttering for the concrete plinth and being secured thereto so that the bolts are set in the concrete at the correct distance from the edge. The bolts cooperate with bolt holes in the bottom of the concrete wall panels and the wall panels are rigidly secured thereto with nuts. Alternatively, tapped sockets may be set in the concrete plinth which co-operate with bolts passing through holes in the base of the wall panels.

In steps B(a) and B(b) the corner pillar of the corner wall panel is preferably one provided with plastics inserts which are correctly positioned when the pillar is being cast in a mould. If a wall panel and corner pillar are fabricated separately the wall panel, which is advantageously constructed in accordance with the first aspect of the invention, is such that it can be connected to the corner pillar by screws which pass through holes in a side flange and co-operate with the plastics inserts in the pillar.

In step B(c) if the further wall panels are constructed in accordance with the first aspect of the invention, they can be joined together by means of bolts passing though the holes in the side flanges and co-operating with nuts.

In step B(d) the temporary bracket is preferably constructed in the form of a timber framework with a hook portion at its vertex which fits closely over the top of the wall panels. Lateral movement of the temporary bracket may be restrained by placing a heavy weight on the member which forms the base of the right-angle triangle.

In step B(f) the ring beam is preferably made of timber and is mot preferably constructed in the form of two or more horizontal layers so that at corners, and at other points where two ring beams meet, the upper and lower layers can overlap so that there is never a vertical join running the full depth of the beam. The ring beams are preferably secured to the wall panels by means of bolts passing through vertical holes in the ring beams and in the top of the wall panels. The length of each individual section of the ring beam is conveniently in the range from 2½ to 4 meters.

In steps B(i) and B(m) the bracing strut is preferably made of timber and may conveniently be temporarily secured to the ring beams by nailing.

In step B(l) the structural partition is preferably a stud partition comprising a timber framework and may be secured to one of the longer walls of the dwelling by nailing or screwing to the ring beam the vertical member at the end of the partition which abuts against the wall.

In step C the roof is preferably supported on conventional roof trusses which are constructed in the form of a triangulated timber framework and which are secured to the ring beams at either end. The roof trusses are conveniently stiffened with panels of plywood which are laid across and secured to corresponding inner inclined members of the trusses, the panels being arranged so that one panel is secured to two or more trusses on one side of the ridge of the roof and another panel is secured to two or more trusses on the other side. The thickness of the sheet material comprising the panels is preferably in the range from 10 to 25 mm.

For a better understanding of the invention and to show more clearly how the same may be carried into effect, reference will now be made, by way of example, to the accompanying drawings in which:

FIG. 1*a* is a front elevation of a concrete wall panel in accordance with the first aspect of the invention;

FIG. 1*b* is a sectional side elevation, taken on the line b—b of FIG. 1*a*, of the concrete wall panel shown in FIG. 1*a*;

FIG. 1*c* is a sectional plan view, taken on the line c—c of FIG. 1*b*, of the concrete wall panel shown in FIG. 1*a*;

Figure 1A:
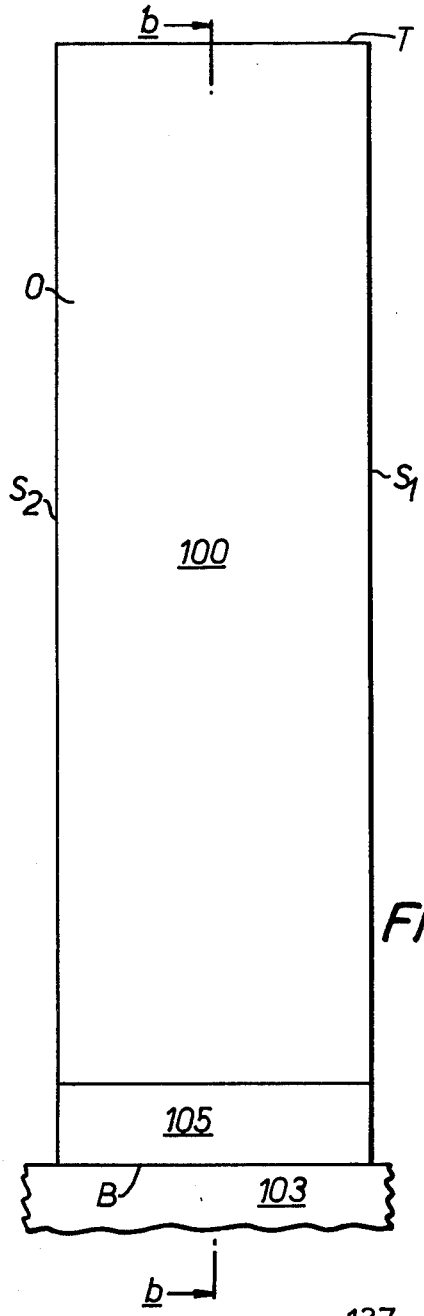
Figure 1B:
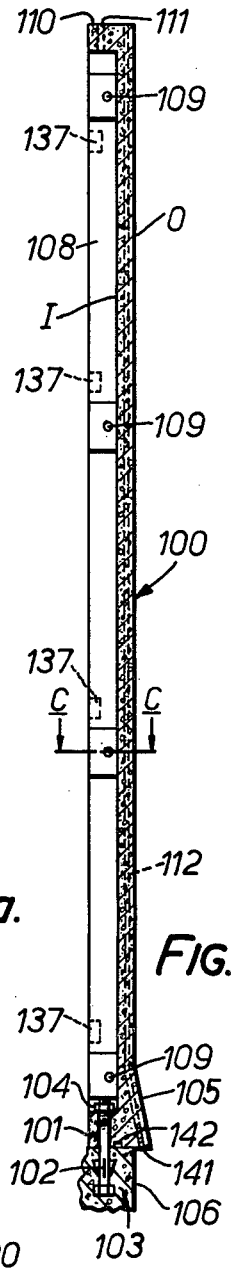
Figure 1C:
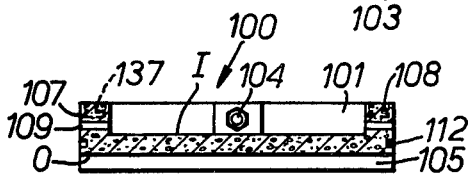

FIGS. 1*a*, 1*b* and 1*c* show a concrete wall panel 100 having an inner face I, and outer face O, a top edge T, a bottom edge B, and two side edges $S_1$ and $S_2$. Adjacent the bottom edge B there projects from the inner face I a bottom flange 101 provided with a single bolt-hole which co-operates with a ragbolt 102 located in a concrete plinth 103. The wall panel 100 is secured to concrete plinth 103 by the co-operation of ragbolt 102 and a nut 104. The lower portion of the outer face O of the wall panel 100 has a flared portion 105 which, when the wall panel 100 is secured to the concrete plinth 103, extends beyond outer edge 106 of the concrete plinth 103. The wall panel 100 is also provided with (a) side flanges 107 and 108, each of which has four bolt-holes 109 for connecting the wall panel to an adjacent wall panel, joinery unit or corner pillar; (b) four inserts 137 made, for example, of a plastics material to receive nails for fixing timber battens to the inner face of the wall panel; and (c) a top flange 110 provided with two bolt-holes 111. A drainage groove 112 of trapeziform cross section is provided in each of side edges $S_1$ and $S_2$, the groove running parallel to the outer face O of the wall panel so that when the wall panel has been erected the groove diverges from the upright at the lower flared portion of the panel to carry drainage water clear of the outer edge 106 of the concrete plinth. Two horizontal grooves 141 and 142, also of trapeziform cross section, are provided in the bottom edge of wall panel 100 to impede progress of water inwardly along the bottom edge B.

Figure 2:
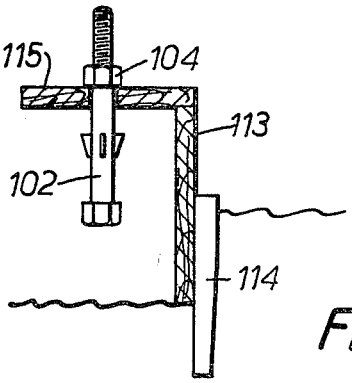
FIG. 2 is a diagrammatic side elevation and FIG. 3 is a diagrammatic front elevation showing a method of locating in a concrete plinth means for anchoring a wall panel.
Figure 3:
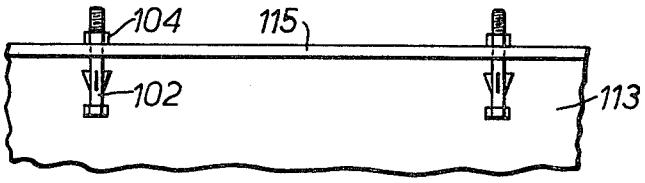

FIGS. 2 and 3 show a method of positioning the ragbolts 102 in the concrete plinth 103. Timber planks 113, which are held in place by pegs 114, form the shuttering for the outer edge 106 of the concrete plinth 103. A timber batten 115 is nailed along the upper edge of the planks 113, the batten being provided with holes in the correct positions and at the correct centres for the ragbolts. The ragbolts 102 are inserted through the holes and suspended temporarily by their nuts 104 while the concrete for the plinth is poured into the area defined by the planks 113 and allowed to set. The nuts 104 are then undone and the shuttering removed.

Figure 4:
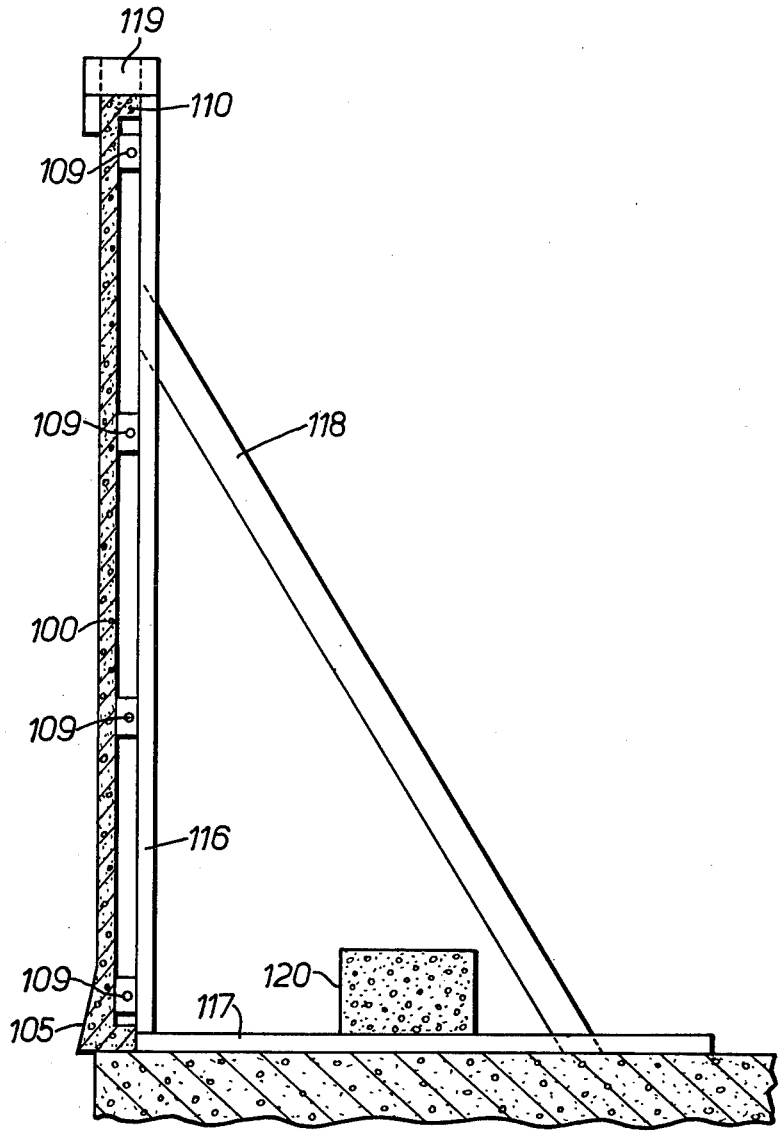
FIG. 4 shows a temporary bracket for a partially completed wall.

FIG. 4 shows a temporary bracket constructed from timber members 116, 117 and 118 rigidly connected together to form a right-angled triangle. A hook portion 119 constructed from a short vertical length of timber connected to the vertical member 116 by two plates of plywood of thickness 1.25 cm fits over the top flange 110 of wall panel 100, thus providing support for the length of wall of which the wall panel 100 is a part, and restraining movement, especially in a direction perpendicular to the plane of the wall panel. Lateral movement of the temporary bracket, such as may result, for example, from the effect of high winds, can be restrained by resting a heavy concrete block 120 on the horizontal timber member 117.

Figure 5:
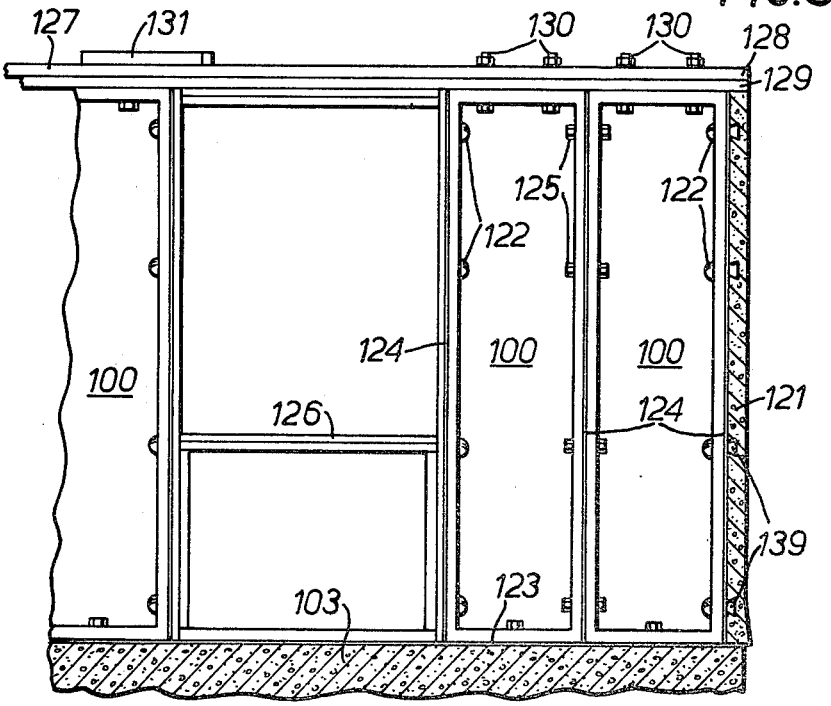
FIG. 5 shows a method of joining together wall panels and a corner pillar to form a wall.

FIG. 5 shows a number of building elements bolted together to form a wall or part of a wall. A corner is formed by securing a wall panel 100 (constructed as described above with reference to FIG. 1) to a corner pillar 121. The corner pillar is cast with frusto-conical inserts 139 made of a plastics material and arranged in two vertical lines of four each, so that each vertical line has inserts facing one of the two mutually perpendicular walls (comprising wall panels 100) which meet at the corner. The wall panel 100 is secured to the corner pillar 121 by means of four screws 122 passing through the bolt-holes 109 into the inserts 139. The wall panel 100 and corner pillar 121, which together form a corner wall panel, are lifted into place and secured by means of a nut to the ragbolt which passes through a bolt-hole in the wall panel 100. A second wall panel is then erected and secured by screws to the corner pillar at right angles to the first wall panel. During the course of erection, a horizontal bituminous damp proof membrane 123 is inserted between the bottom of each wall panel and the concrete plinth and a vertical damp proof membrane 124 is inserted between the sides of adjacent building elements, extending from the inner face of the elements to the drainage groove 112 only. Adjacent concrete wal panels are secured togeher by nut and bolt assemblies 125. The concrete wall panels are fastened to joinery unit 126 by screws 122 which pass through the bolt-holes 109 in the wall panel into the wooden frame of the joinery units. A ring beam 127 is formed from lengths of timber in two layers, an upper layer 128 and a lower layer 129. At corners and where lengths of timber meet there is an overlap between the upper and lower layers so that a vertical join never extends the full depth of the ring beam. The ring beam is secured to the top flanges 110 of the concrete wall panels 100 by nut and bolt assemblies 130. A temporary timber bracing strut 131 is secured diagonally across the corner by nailing to the ring beam at each end.

Figure 6:
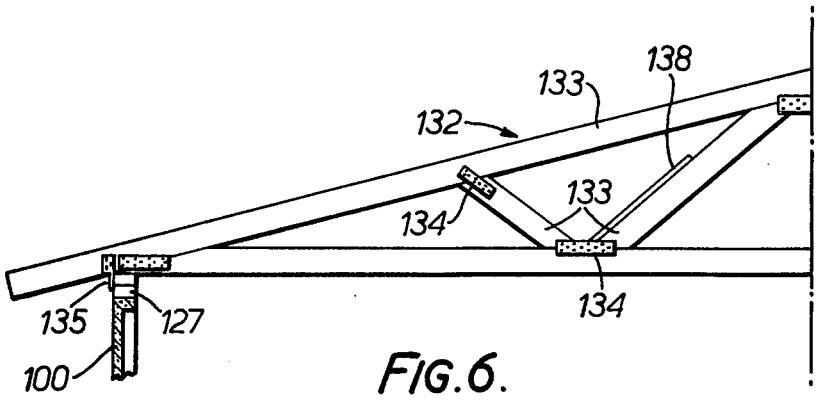
FIG. 6 is a front elevation of part of a roof truss; p
Figure 7:
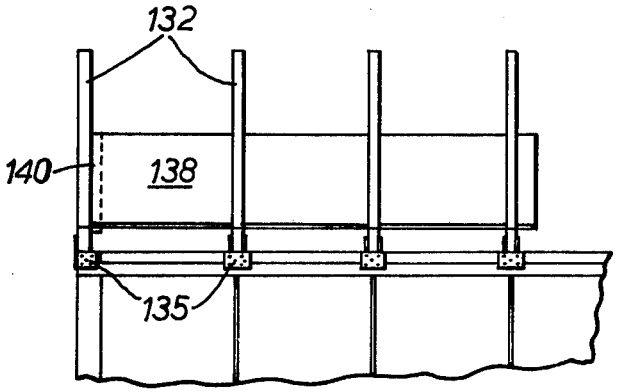
FIG. 7 is a side elevation of four adjacent roof trusses.

FIGS. 6 and 7 show how roof trusses are constructed and the method of securing them to the walls. Each roof truss comprises timber members 133 connected together to form a framework in the form of an isosceles triangle of small basal angle stiffened by inclined bracing struts. At the nodes where timber members meet, they are connected together by means of perforated plates 134 through which nails are driven. The complete roof truss is secured to the ring beams surmounting the two longer walls of the dwelling unit by means of hurricane clips 135, each of which comprises a perforated flat portion through which nails are driven into the ring beam 127, and a perforated channel portion which partially encloses the horizontal member of the roof truss and through which nails are driven. The roof timbers are stiffened at each end of the roof by sheets of plywood 138 of thickness not less than 1.25 cm which are nailed to the inclined bracing struts, one on each side of the centre line of the trusses, the length of each plywood sheet 138 being such that one sheet spans the four roof trusses at each end of the roof. At the gable ends a timber bearer 140 is screwed one on each side of the centre line on one face of the gable truss to provide additional support for the plywood sheets.

Figure 8:
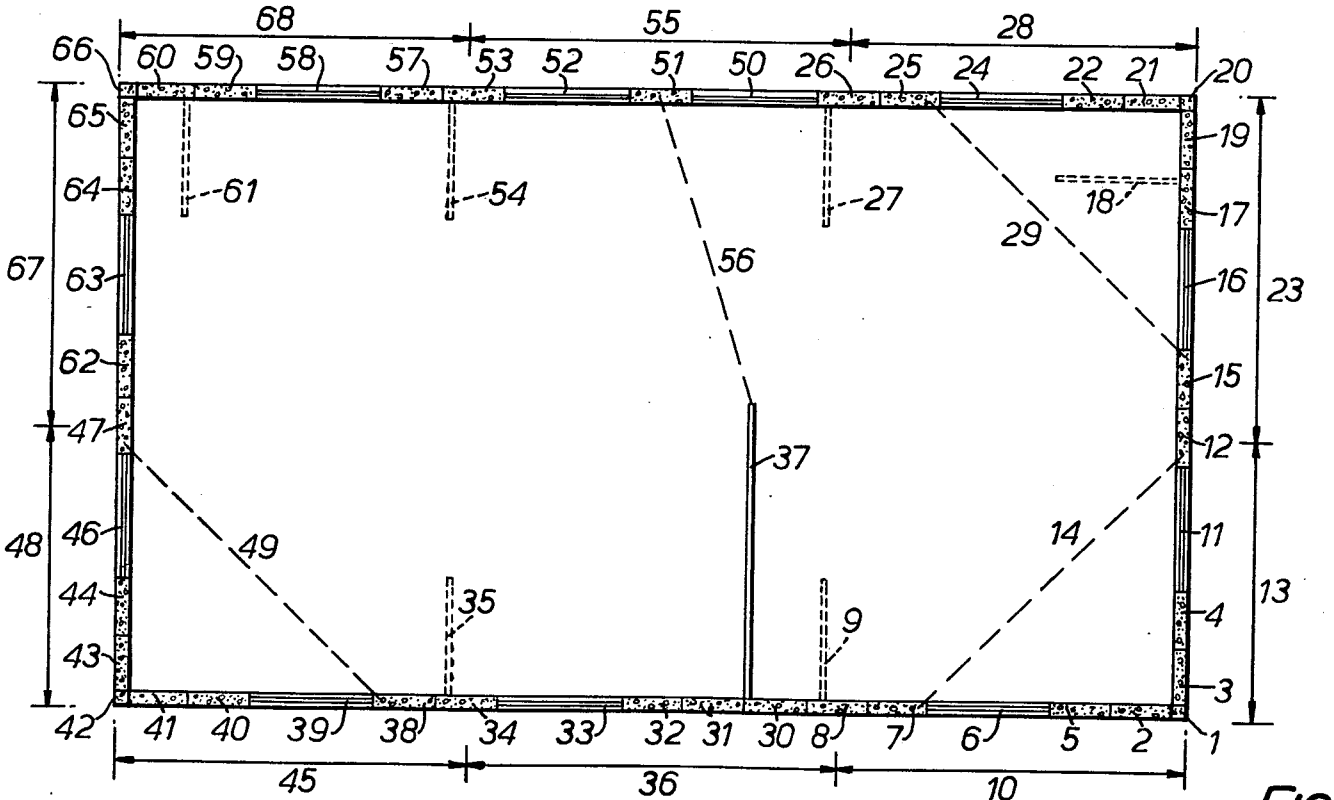
FIG. 8 is a diagram showing one sequence of erecting wall panels to build a dwelling in accordance with the second aspect of the invention.

FIG. 8 is a diagram showing schematically the sequence in which there were erected the various building elements of a bungalow suitable for habitation in a tropical region where hurricanes are a possible hazard.

The site was first excavated, with trenches for wall foundations cut down to a suitable firm base and filled with concrete reinforced with mild steel rods of diameter 1.5 cm. The site area defined by the wall foundations was filled with hardcore, or other suitable material such as sand or gravel, which was well rammed and consolidated and suitably blinded to receive a polyethylene damp-proof membrane. A concrete floor was then formed to a depth of 10 cm from concrete reinforced with steel mesh. The wall foundations and the floor together formed a concrete plinth in which were set ragbolts at appropriate positions to receive concrete wall panels.

The construction of the bungalow then continued as set out below. When I refer herein to the erection of a concrete wall panel it is to be understood that this includes placing a horizontal damp-proof course between the bottom of the wall panel and the concrete plinth, lifting the wall panel over the ragbolt in the floor and tightening the nut, placing a vertical damp-proof course between the wall panel being erected and a panel or other building element adjacent to it and tightening the bolts connecting the wall panel to said other building element. Similarly, when I refer herein to a ring beam being placed this includes bolting the ring beam to the top flange of the concrete wall panels and to the head of the timber joinery units.

Corner pillar 1 and wall panel 2 were screwed together to form a corner wall panel which was then erected; wall panels 3, 4 and 5, joinery unit 6 and wall panels 7 and 8 were then erected; wall panel 8 was supported with a temporary bracket 9; ring beam 10 was placed; joinery unit 11 and wall panel 12 were erected; ring beam 13 was placed and the corner braced with timber strut 14; temporary bracket 9 was removed; wall panel 15, joinery unit 16 and wall panel 17 were erected and supported with temporary bracket 18; wall panel 19 and corner pillar 20 were screwed together to form a corner wall panel which was then erected; wall panels 21 and 22 were erected and temporary bracket 18 was removed; ring beam 23 was placed; joinery unit 24 and wall panels 25 and 26 were erected and supported with temporary bracket 27; ring beam 28 was placed and the corner braced with timber strut 29; the temporary bracket 27 was removed; wall panels 30, 31, and 32, joinery unit 33 and wall panel 34 were erected and supported with temporary bracket 35; ring beam 36 was placed; structural partition 37 was erected and secured to ring beam 36 and to the floor; wall panel 38, joinery unit 39 and wall panels 40 and 41 were erected; corner pillar 42 and wall panel 43 were secured together and erected; wall panel 44 was erected; temporary bracket 35 was removed and ring beam 45 placed immediately; joinery unit 46 and wall panel 47 were erected; ring beam 48 was placed and the corner braced with timber strut 49; at this point a check was made to ensure that all prefabricated partitions were inside the building; joinery unit 50, wall panel 51, joinery unit 52 and wall panel 53 were erected and supported with temporary bracket 54; timber strut 56 was placed so as to brace ring beam 55, and thus wall panels 51 and 53 and joinery units 50 and 52, from the structural partitions 37; temporary bracket 54 was removed; wall panel 57, joinery unit 58 and wall panels 59 and 60 were erected and supported with temporary bracket 61; wall panel 62, joinery unit 63 and wall panel 64 were erected; wall panel 65 and corner pillar 66 were secured together and erected; ring mean 67 was placed; temporary bracket 61 was removed and ring beam 68 was placed; the remaining prefabricated partitions were then erected and secured to the ring beams; and the roof trusses were also erected and secured to the ring beams by hurricane clips, the timber struts 14, 29, 49 and 56 being removed as construction of the roof proceeded to completion.

The method of the invention may also be used for building houses, and in this case the lower storey would be built essentially as described above, the concrete wall panels and timber framed joinery units being surmounted by a heavy ring beam similar to that described for the bungalow, and the upper storey would be of timber framed units screwed or bolted to the lower ring beam at their base and to a second ring beam at the top. The roof would then be secured to the upper ring beam and suitable cladding would be attached to the outer face of the timber framed units not occupied by windows.

What is claimed is:

1. A building element for use in constructing a building, said element comprising a rectangular panel of a height, when upright, substantially equal to one story of the building such that a plurality of such panels laterally adjacent each other can form a story of the building, said panel having an inner face, an outer face, a top edge, a bottom edge and two side edges, wherein the inner face has four flanges each of which projects from said inner face adjacent to a respective one of said top, bottom and two side edges, each of said flanges extending the whole or substantially the whole length of the edge to which it is adjacent, wherein the bottom edge and the two side edges each have at least one groove running the length thereof, and wherein the flanges adjacent said top, bottom and two side edges are provided with means suitable for, or suitable for use in, the fixing of the building element to another similar or different building element, and wherein the outer face of the panel has an outwardly flared portion adjacent the bottom edge of the panel.

2. A building element as claimed in claim 1, wherein the grooves formed in the bottom and side edges of the panel have a polygonal cross-section.

3. A building element as claimed in claim 1, wherein said bottom and top edges are provided with one and two bolt-holes, respectively.

4. A building element as claimed in claim 1 wherein the grooves in the side edges diverge outwardly adjacent the flared bottom of the panel so as to run substantially parallel to the outer face of the panel, including the outwardly flared portion.

* * * * *